US005419434A

United States Patent [19]

Capoccia

[11] Patent Number: 5,419,434

[45] Date of Patent: May 30, 1995

[54] PACKAGED STIPPLE BRUSH WITH DEFINED PATTERN AND ANGLED BRISTLES AND METHOD OF CONSTRUCTING

[76] Inventor: John S. Capoccia, 6124 Cheshire Rd., Galena, Ohio 43021

[21] Appl. No.: 947,772

[22] Filed: Sep. 18, 1992

Related U.S. Application Data

[63] Continuation-in-part of Ser. No. 773,020, Oct. 7, 1991, abandoned, which is a continuation-in-part of Ser. No. 598,885, Oct. 15, 1990, abandoned.

[51] Int. Cl.[6] ..... B65D 83/10

[52] U.S. Cl. ..... 206/361; 206/461; 206/495; 53/397; 53/436

[58] Field of Search ..... 15/160, 180, 191.1; 206/361, 362.2, 461, 477, 495; 53/397, 436, 528, 529

[56] References Cited

U.S. PATENT DOCUMENTS

| | | | |
|---|---|---|---|
| 400,475 | 4/1889 | Nimschke | 15/191.1 |
| 601,405 | 3/1898 | Shepherd | 15/191.1 |
| 2,845,176 | 7/1958 | Wicks | 206/477 |
| 3,860,117 | 1/1975 | Walus et al. | 206/461 |
| 3,943,594 | 3/1976 | Alvin | 15/180 |
| 4,039,079 | 8/1977 | Laughton | 206/461 |

FOREIGN PATENT DOCUMENTS

| | | | |
|---|---|---|---|
| 3201 | 7/1931 | Australia | 206/361 |
| 70150 | 6/1941 | Czechoslovakia | 206/495 |

*Primary Examiner*—David T. Fidei
*Attorney, Agent, or Firm*—Mueller and Smith

[57] ABSTRACT

The invention relates to a packaged stipple brush and its method of construction. The stipple brush is constructed of brush receptacles retaining brush elements for transferring a generally radial pattern to topping compound applied to a surface. The brush receptacles are acutely angled with respect to the centerline of the brush which predisposes the brush elements to lie in a flattened manner, thus eliminating the need for the craftsman or other user to train the stipple brush prior to its use. The brush elements are further trained to lie flat by the method in which a fully assembled brush is removably captively retained against a flat surface, such as a point of sale display, during it shipping, storage, and display. In this manner the package becomes part of the manufacturing process for the stipple brush. The brush of the present invention also is unique in that the brush elements are arranged in predefined patterns which produce pleasing and consistent ceiling patterns when the lengthwise extent of the brush elements contact wet stipple or topping medium.

24 Claims, 4 Drawing Sheets

PACKAGED STIPPLE BRUSH WITH DEFINED PATTERN AND ANGLED BRISTLES AND METHOD OF CONSTRUCTING

CROSS REFERENCE TO RELATED APPLICATION

This application is a continuation-in-part of application Ser. No. 07/773,020, filed Oct. 7, 1991, now abandoned, which was a continuation-in-part of application Ser. No. 07/598,885, filed Oct. 15, 1990, now abandoned.

BACKGROUND OF THE INVENTION

The finishing of drywalled ceilings in newly constructed or remodeled homes and offices typically employs a stippling process whereby ceilings are endowed with a textured, in lieu of a smooth, plastered finish. Application of such stippling textures can add aesthetic appeal to a room while simultaneously lessening the time required to "finish" the ceiling since minor surface imperfections are concealed by the applied texture.

During the construction of drywall type ceilings, adjacent drywall sheets abuttably contact one another, forming a discontinuous joint. Where a finished surface is desired, this joint typically is covered by the plasterer applying a plaster-based joint compound and paper tape over the seam and then smoothed out with a trowel to give the appearance of a continuous surface. After the compound has dried completely, a finishing coat of compound is applied. Where a textured ceiling finish is desired, a coat of topping compound is applied to the entire ceiling to be textured with a roller brush after the second coat of compound has been allowed to dry. Immediately upon applying the topping compound and while it is still wet, repetitive stipple patterns may be applied to the compound with a bristled brush to impart a texture to the ceiling surface. The texture pattern created by a brush is, to a large extent, determined by the length, angle and density of the brush's bristle population, as well as the viscosity of the topping compound. Stipple patterns are imparted into the wet topping compound as the contacting portion of the brush elements are drawn away from the compound.

A commonly practiced method of applying stipple patterns employs a conventional window cleaning brush attached to the end of a handle which then is dabbed into wet topping compound. While other types of brushes could be employed to apply stipple texture, such as a hatter's brush as disclosed in U.S. Pat. No. 396,812, window cleaning brushes typically are used because they are readily available to the drywall finishing trade. However, since window cleaning brushes are provided with vertically oriented and densely populated bristle arrangements, in order for them to be used as stipple brushes capable of applying consistent, generally radial stipple patterns, they must be substantially altered. Such bristle arrangement, if used in its unmodified state, would produce an inconsistent and discontinuous pattern, since it is the outer portions of the bristle lengths that would be contacting the topping compound and imparting a pattern. Even if compressed against the compound covered ceiling, an "untrained" window brush will leave an inconsistent pattern, since successive contact with the ceiling may be made with differing pressures and the bristles may spread differently each time. Consequently, any untrained brush, having generally vertically oriented bristle arrangements, would not produce a consistent, generally radial stipple pattern since such pattern requires significant lengthwise bristle contact with the wet topping compound.

In order to modify an off-the-shelf window cleaning brush to produce a generally radial stipple pattern, a substantial portion of the brush's bristles must first be removed. This thinning is required so the vertically disposed bristles can be "trained" in a radiating manner as to allow the lengthwise extent of the bristles to make parting contact with the topping compound. Bristle elements may be trained to be biased in such a radial manner by compressing a wet brush face down against a flat surface for an extended period of time. Alternately, chemically pre-trained window cleaning brushes are commercially available, such as the stipple texture brushes offered by Goldblatt Co. However, while the Goldblatt brush offers time savings which is normally spent in training a brush to lie flat, the Goldblatt brush offers no additional advantages over the standard, unmodified and untrained window cleaning brush. Only after a window brush's bristles have been adequately thinned out and trained to lie flat can the brush effectively be used to apply consistent radial stipple patterns.

However, since the modification process may vary substantially from one brush to the next, even modified and trained window brushes will produce inconsistent stipple patterns. Further, inconsistent patterns may be introduced through improper storage of a brush between uses, effectively "re-training" the brush elements in an undesirable orientation.

Inconsistent stipple patterns are not desirable and often are a source of customer complaint requiting the complete removal of the non-conforming ceiling texture in order to satisfy a customer's aesthetic tastes. Removing dried topping compound having inconsistent patterns is time consuming and generally represents an expense borne by the drywall contractor. Consequently, it is often necessary to employ the same modified window brush to finish the entire ceiling of a house to avoid visual inconsistencies that would lead to such remedial measures.

In addition to producing stipple patterns which may unintentionally vary from one modified brush to the next, the conversion of a conventional window cleaning brush into a stippling brush is inconvenient, time consuming, and prevents the brush from being used until after it has been so conditioned.

A better stipple brush would employ pre-biased brush elements which would not require substantial pre-conditioning and would contain brush elements which would produce a predetermined variety of distinctive, yet repeatable, stipple patterns. Such a pre-trained stipple brush having predetermined patterns of brush elements would save drywallers time and produce more consistent textural results. In application Ser. Nos. 07/597,885 and 07/773,020, Capoccia appreciated the need to reduce the amount of training that a craftsman has to do to a stipple brush prior to its use and disclosed a brush that could be manufactured with bristle elements at an angle from horizontal of around 20°–30°. Subsequently and upon further examination of manufacturing techniques, it has been discovered that, currently, there are practical limitations on the angle that automated machinery can drill into the base of the brush for providing brush receptacles. Thus, there exists a need in the art to improve the manufacturing process of such pre-trained stipple brushes.

SUMMARY

The present invention is addressed to a stipple brush and the method of its construction. The inventive stipple brush incorporates a portion of a brush's point-of-sale packaging as a key element in the manufacturing process of making the brush. The final step in the manufacture of the brush of the instant invention is training the bristle elements of the brush to lie flat by captively retaining the brush in a compressed state against a card or other planar surface. The brush remains in its "trained" state until it is unpackaged for its intended use.

The invention features a packaged stipple brush for storage and display at the point-of-sale which stipple brush is useful for transferring patterns to a stipplable topping compound at a surface. The packaged brush is constructed of a base having sides and a centerline, and has a plurality of brush element receptacles formed in a pattern in one side thereof. Each receptacle is disposed at an acute angle with respect to the centerline. A plurality of brush elements corresponding to the number of the brush element receptacles are secured in said receptacles to form a completely assembled brush. A planar surface is provided against which the assembled brush is compressed to spread the brush elements outwardly in a symmetrically radial manner. A removable retaining means is provided for captively retaining the assembled brush in compressed relationship with the planar surface while the packaged brush is being stored, thereby training the brush elements to lie flat.

The invention further features a method of constructing a packaged stipple brush, which comprises the steps of:

(a) providing a brush comprising:

a base plate having a centerline extending perpendicularly therethrough, a first side, and a second side disposed opposite said first side having a predetermined pattern of brush receptacles disposed therein, each of said receptacles being disposed at an acute angle with respect to said centerline; and a plurality of brush elements, each of said brush elements having an end disposed in one of said receptacles to form an assembled brush;

(b) providing a planar surface; and (c) removably retaining said brush elements in a compressed relationship against said planar surface such that said elements spread outwardly in a symmetrically radial manner for training said assembled brush.

Other features of the invention will, in part, be obvious and will, in part, appear hereinafter. The invention, accordingly, comprises the apparatus and method possessing the construction, combination of elements, arrangement of parts which are exemplified in the following detailed description For a fuller understanding of the nature and objects of the invention, reference should be had to the following detailed description taken in connection with the accompanying drawings.

DETAILED DESCRIPTION OF THE INVENTION

The apparatus and method of the instant invention overcome many of the drawbacks inherent in the makeshift stipple brushes heretofore available in the art. The apparatus disclosed is a stipple brush that incorporates part of its packaging as the final stage of the brush manufacturing process. It is generally known by those in the stippling trade that it is desirable to use a stipple brush that has flattened out bristles in order to impart consistent, generally radial stipple patterns onto newly installed ceilings.

While applicant has disclosed an improved stipple brush and the method for its construction in earlier applications cited above, he has learned of certain manufacturing limitations that currently render mass production of his earlier brush impractical. The present invention uses brush drilling equipment to form brush angles as low as practical and then achieves the advantageous final angle through training by the unique process of affixing the brush to a card which is also used as a point-of sale display.

Figure 1:
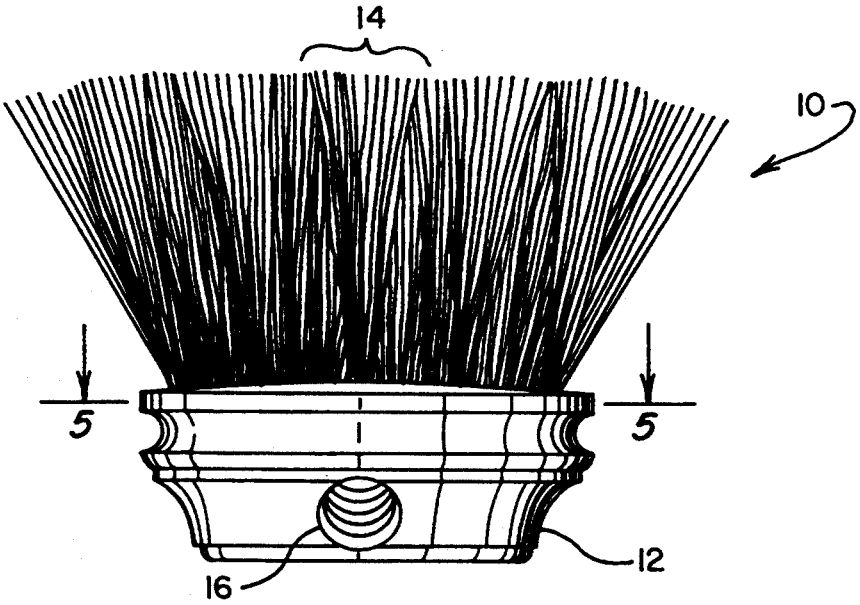
FIG. 1 is an elevational view of an assembled stipple brush according to the present invention.
Figure 4:
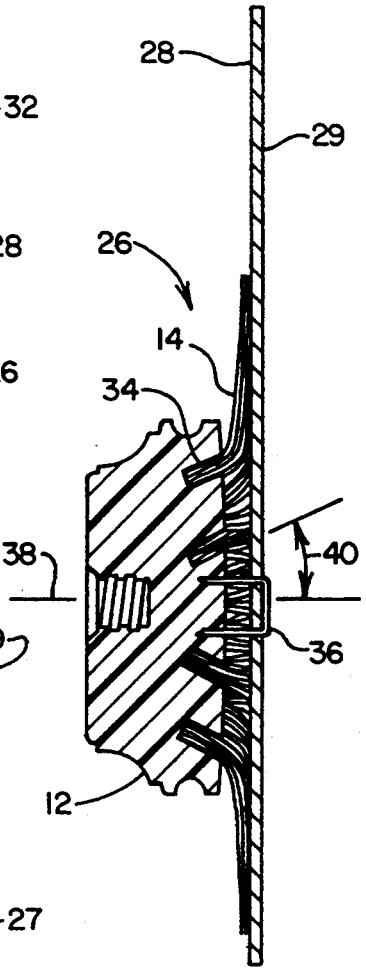
FIG. 4 is a sectional view of the packaged stipple brush taken through section 4—4 according to the present invention.
Figure 5:
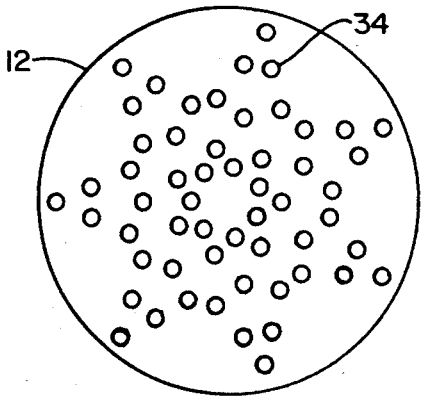
FIGS. 5–11 are alternate brush receptacle patterns taken through section 5—5 according to the present invention.
Figure 6:
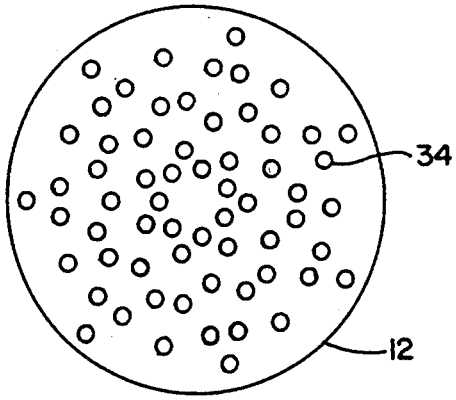
Figure 7:
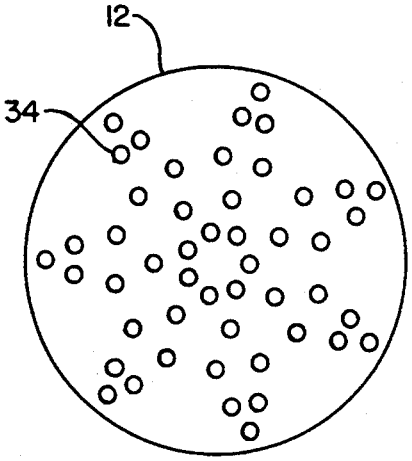
Figure 8:
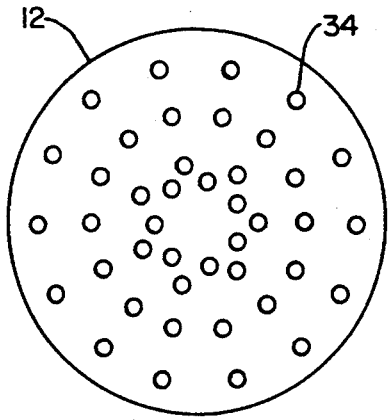
Figure 9:
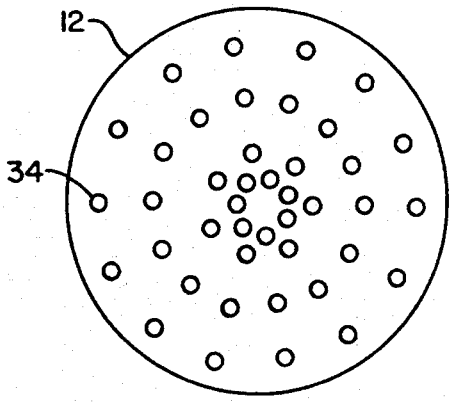
Figure 10:
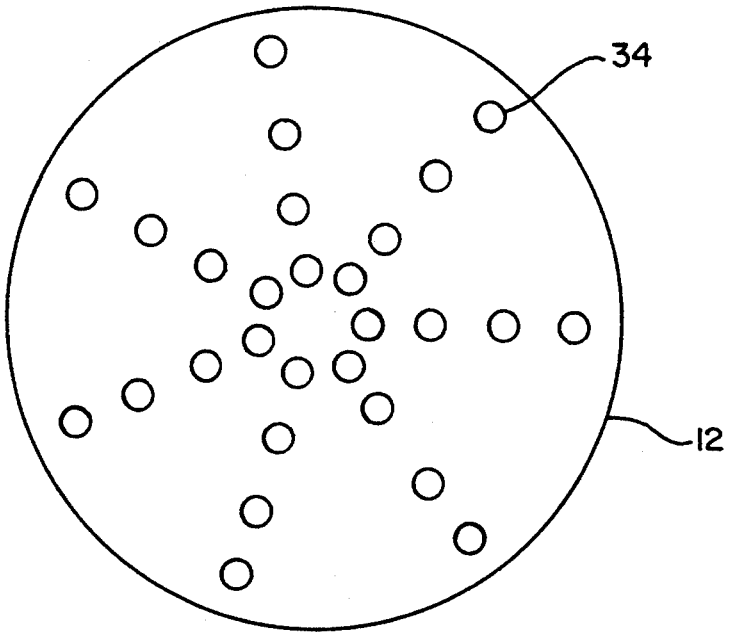
Figure 11:
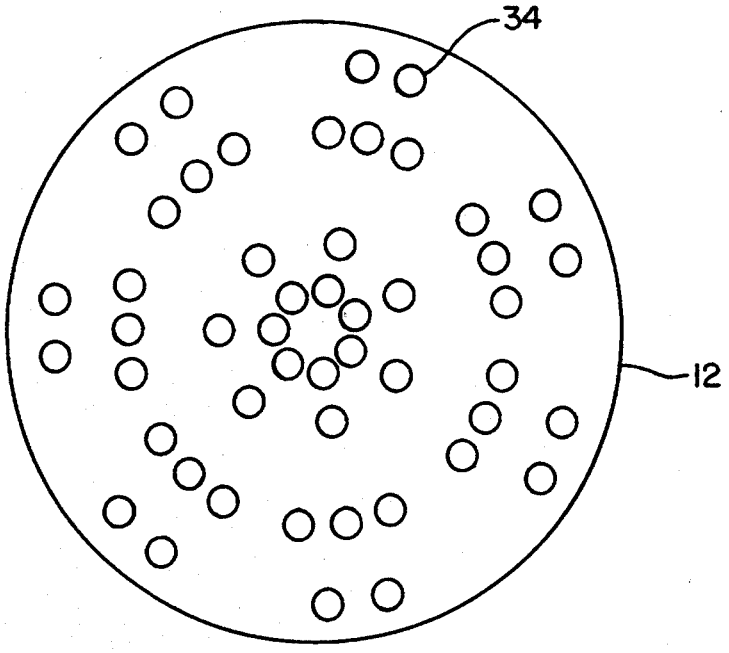

Looking to FIG. 1, stipple brush 10 according to the invention is illustrated in its fully assembled, but unfinished state. It can be seen that a plurality of brush elements, as at 14, have been secured into brush receptacles 34 (as shown in FIG. 4) which have been formed into base 12. Brush elements may selected from a variety of materials such as tampico, horse hair or polypropylene, but a blend of about 60% polypropylene and 40% natural horse hair has been determined by the trade to be most acceptable for its appearance and durability. Base 12 is constructed of molded plastic, but also could be constructed of wood or other suitable material. Threaded side handle hole 16 provides a means for attaching a brush handle (not shown) on the side of stipple brush 10.

Referring briefly to FIG. 4, brush element receptacles 34 are shown in cross-section to be imbedded into base 12. The diameter of brush element receptacles 34 of the present invention are approximately 0.1875" at a nominal depth of 0.4375". As would be obvious to one skilled in the art, the holes may be formed by numerous methods which would include drilling, molding, or melt-forming.

Also shown in FIG. 4 is the angular orientation of all brush element receptacles 34. This feature is one of the keys of the invention since it enhances the ability of the stipple brush 10 to be properly trained in a flattened manner. The commonality of the angle of brush element receptacles 34 present in one embodiment of the invention is unique to the present invention since most brushes in the art have vertical brush elements at their center.

Figure 2:
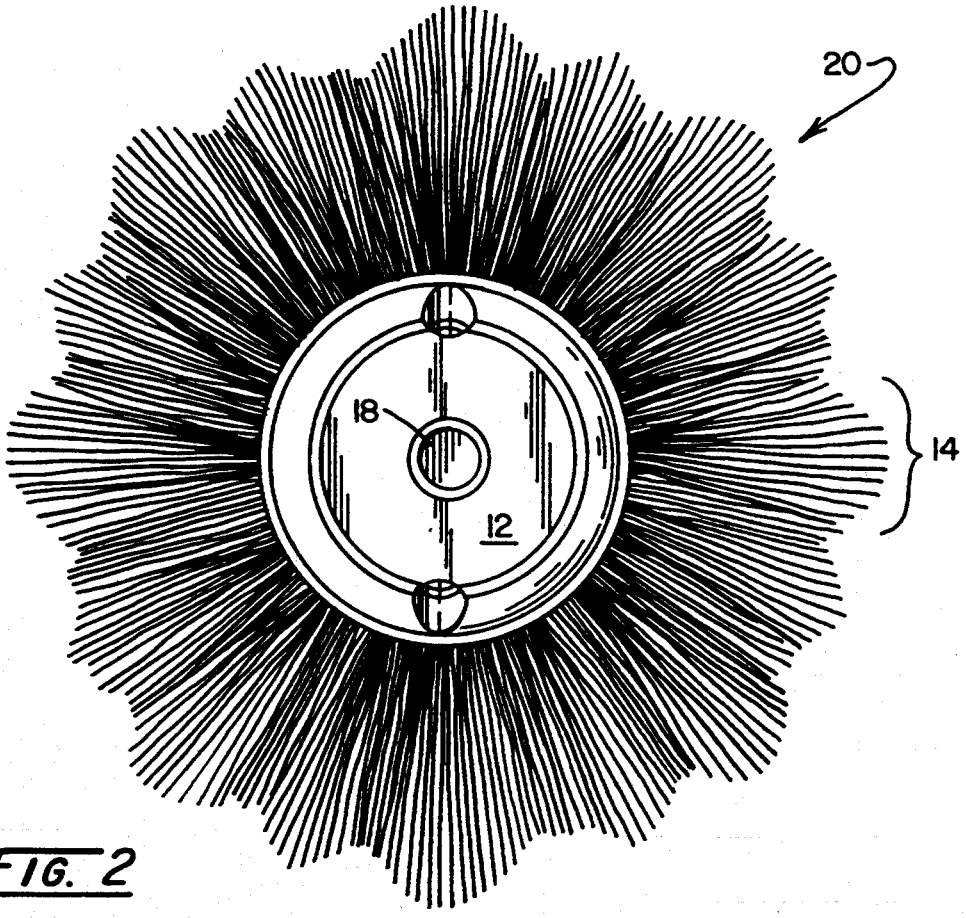
FIG. 2 is a plan view of the assembled brush face being compressed such that the brush elements spread outwardly in a symmetrically radial pattern according to the invention.

Referring now to FIG. 2, assembled brush 10 is shown in its compressed state 20. The angle of brush elements 14, disclosed in FIG. 4, and the density and unique pattern of brush element receptacles 34, shown in FIGS. 5–11, urge brush elements 14 to spread out in a symmetrical radial manner when vertically compressed. This, too, is a unique feature of the present invention.

Figure 3:
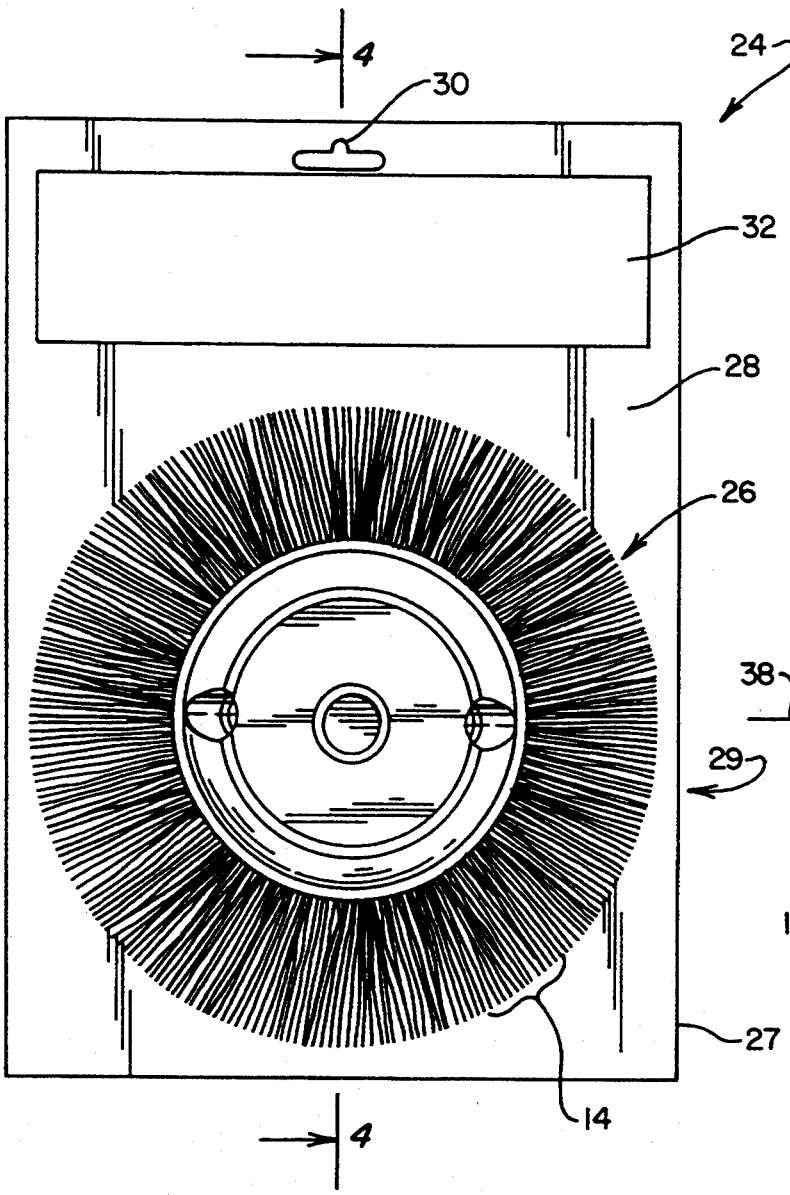
FIG. 3 is a plan view of one embodiment of the packaged stipple brush according to the present invention.

Compressed stipple brush 20 is shown having brush elements 14 of varying length. However, prior to packaging and while the brush is in a compressed state 20, bristle elements 14 may be trimmed such that all of the brush elements 14 terminate in a common circumferential perimeter. Trimmed stipple brush 26 with brush element 14 having a common perimeter is shown in FIG. 3. Alternately, it is understood as part of the instant invention that the lengths of bristle elements 14 could be selected and assembled such that no additional trimming was necessary to achieve the common perimeter effect. Threaded center handle hole 18 is provided for mounting of a brush handle (not shown) to accommodate the stippling of ceilings.

Referring to FIG. 3, packaged stipple brush 24 is shown to contain trimmed stipple brush 26 compressed against front surface 28 of rectangular card 27. The retained compression of brush elements 14 in a flattened state is the unique final step in the manufacturing of the stipple brush of the present invention. Card 27 is shown to have space 32 for point-of-sale information on front surface 28. It is anticipated that instructional information, such as directions for the use and care of stipple brush 26 can be applied to the back surface 29 of card 27. It is anticipated that sales and instructional information may be applied to card 27 by conventional printing methods, or through the use adhesive labels or flyers. Card 27 also may be fitted with die cut slot 30 for hanging packaged stipple brush 24 on a hook during storage or at the point-of-sale.

FIG. 4 depicts packaged stipple brush 24 in cross-section. Brush receptacles 34 are all shown to be at common angle 40 with respect to centerline 38 which passes perpendicularly through base 12. Since the angle of brush elements 14 determines how effective the training of assembled brush 10 will be, it is desirable to make angle 40 as large as possible, without exceeding around 70°–80°. However, it has been determined that the largest angle 40 currently feasible for automated machinery to form brush element receptacles 34 is around 33°. Accordingly, it is preferred that angle 40 is provided to be from about 5° to about 40° with respect to centerline 38.

Stipple brush 26 is captively retained in a compressed state against front surface 28 of card 27 by one or more removable fasteners 36. While retaining fastener 36 is shown to be a staple, the invention includes the use of other means as well, including screws, adhesive, and elastic bands. Furthermore, the invention anticipates that brush 26 can also be retained in a compressed state by other packaging techniques such shrink wrapping, blister packaging, paperboard box, or the like. It has been determined that adequate training of the brush can be achieved if assembled brush 10 remains in a compressed state for at least a week. However, it is not anticipated that it will harm packaged brush 24 in any respect to remain in such a compressed state for extended periods.

FIGS. 8–14 depict various unique patterns of angled brush receptacles 34 formed into base 12. The combination of the angle of brush receptacles 34, and the density and arrangement of these distinctive patterns, urge brush elements 14 to spread out in a symmetrically radial pattern when compressed. This key feature of the instant invention enables compressed brush 20 to be quickly and consistently trimmed and mounted onto its unique training package 24.

I claim:

1. A method for constructing a packaged stipple brush, which comprises the steps of:

(a) providing a brush comprising:

a base plate having a centerline extending perpendicularly therethrough, a first side, and a second side disposed opposite said first side having a predetermined pattern of brush receptacles disposed therein, each of said receptacles being disposed at an acute angle with respect to said centerline; and a plurality of brush elements, each of said brush elements having an end disposed in one of said receptacles to form an assembled brush;

(b) providing a planar surface having a front side and an oppositely disposed back side; and (c) removably attaching said brush to the front side of said surface to retain said brush elements in a compressed relationship against said planar surface such that said elements are spread outwardly in a symmetrically radial manner for training said assembled brush.

2. The method of claim 1 further comprising the step of sizing said plurality of brush elements such that the end opposite said receptacle of each said brush elements terminates in a common circumferential perimeter.

3. The method of claim 1 further comprising the step of providing information relating to said brush by associating printed materials with at least one side of said planar surface.

4. The method of claim 3 wherein said information relates to the use and care of said stipple brush.

5. The method of claim 1 further comprising the step of displaying said brush at a point of sale location where said packaged stipple brush is offered for sale on said planar surface to which said brush is captively retained.

6. The method of claim 1 further comprising the step of angling each of said formed brush receptacles at a common angle of between 5° and 40° from said centerline.

7. The method of claim 1 further comprising the step of providing a pattern of brush receptacles comprised of a 7 pointed star-shaped perimeter surrounding 3 groups of receptacles, said grouped receptacles being evenly spaced around a corresponding number of concentric circles therein.

8. The method of claim 7 further comprising the step of providing a pattern of brush receptacles distributed evenly around a common radius extending beyond said star-shaped perimeter.

9. The method of claim 1 further comprising the step of providing a pattern of brush receptacles comprised of a 7 pointed star-shaped perimeter surrounding 2 groups of receptacles, said grouped receptacles being evenly spaced around a corresponding number of concentric circles therein.

10. The method of claim 1 further comprising the step of providing a pattern of brush receptacles comprised of a circular perimeter having evenly spaced receptacles surrounding 3 groups of receptacles, said grouped receptacles being evenly spaced around a corresponding number of concentric circles therein.

11. The method of claim 10 further comprising the step of providing a pattern in which the innermost concentric circle bearing evenly spaced brush receptacles has a radius of about one half that of the next larger concentric circle.

12. The method of claim 1 further comprising the step of providing a pattern of brush receptacles comprised of a circular perimeter having evenly spaced receptacles surrounding 3 groups of receptacles, said grouped receptacles being evenly spaced around a corresponding number of concentric circles therein and in radial alignment with receptacles in adjacent concentric groups.

13. The method of claim 1 further comprising the step of providing a pattern of brush receptacles comprised of a circular perimeter having a plurality of evenly spaced paired receptacles, said perimeter surrounding 3 groups of receptacles, said grouped receptacles being spaced around a corresponding number of concentric circles therein.

14. A packaged stipple brush for storage and display at a point of sale, said stipple brush for transferring patterns to a stipplable topping compound at a surface, which comprises:

(a) a planar surface having a front side and an oppositely disposed back side;

(b) a base having sides and a centerline, said base having a plurality of brush element receptacles formed in a pattern in one side, each of said receptacles being disposed at an acute angle with respect to said centerline;

(c) a plurality of brush elements corresponding to the number of said brush element receptacles secured in said receptacles to form an assembled brush, said brush elements compressed against said planar surface and spread outwardly in a symmetrically radial manner; and (d) means for removably attaching said assembled brush to the front side of said planar surface to retain said brush elements in a compressed relationship against said planar surface such that said elements are spread outwardly in a symmetrically radial manner for training said assembled brush.

15. The packaged stipple brush of claim 14 wherein said planar surface is made of cardboard.

16. The packaged stipple brush of claim 14 wherein said planar surface supports printed sales and instructional information relating to said brush.

17. The packaged stipple brush of claim 14 wherein said means for attaching said brush to said surface comprises at least one staple.

18. The packaged stipple brush of claim 14 wherein said pattern is comprised of a plurality of brush receptacles arranged as a 7 pointed star-shaped perimeter surrounding 3 groups of receptacles, said grouped receptacles being evenly spaced around a corresponding number of concentric circles therein.

19. The packaged stipple brush of claim 18 wherein said pattern further includes a plurality of brush receptacles distributed evenly around a common radius extending beyond said star-shaped perimeter.

20. The packaged stipple brush of claim 14 wherein said pattern is comprised of a plurality of brush receptacles arranged as a 7 pointed star-shaped perimeter surrounding 2 groups of receptacles, said grouped receptacles being evenly spaced around a corresponding number of concentric circles therein.

21. The packaged stipple brush of claim 14 wherein said pattern is comprised of a plurality of brush receptacles arranged in a circular perimeter having evenly spaced receptacles surrounding 3 groups of receptacles, said grouped receptacles being evenly spaced around a corresponding number of concentric circles therein.

22. The packaged stipple brush of claim 21 wherein said pattern additionally comprises a plurality of brush receptacles arranged as a pattern in which the innermost concentric circle bearing evenly spaced brush receptacles has a radius of about one half that of the next larger concentric circle.

23. The packaged stipple brush of claim 14 wherein said pattern is comprised of brush receptacles arranged as a circular perimeter having evenly spaced receptacles surrounding 3 groups of receptacles, said grouped receptacles being evenly spaced around a corresponding number of concentric circles therein and in radial alignment with receptacles in adjacent concentric groups.

24. The packaged stipple brush of claim 14 wherein said pattern is comprised of brush receptacles arranged as a circular perimeter having a plurality of evenly spaced paired receptacles, said perimeter surrounding 3 groups of receptacles, said grouped receptacles being spaced around a corresponding number of concentric circles therein.

* * * * *